US008145091B2

(12) United States Patent
Inada

(10) Patent No.: US 8,145,091 B2
(45) Date of Patent: Mar. 27, 2012

(54) IMAGE FORMING APPARATUS AND METHOD OF CLEANING SECONDARY TRANSFER ROLLER USED THEREIN

(75) Inventor: Yasuyuki Inada, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 378 days.

(21) Appl. No.: 12/390,075

(22) Filed: Feb. 20, 2009

(65) Prior Publication Data

US 2009/0304403 A1 Dec. 10, 2009

(30) Foreign Application Priority Data

Jun. 5, 2008 (JP) ..... 2008-147734

(51) Int. Cl.
*G03G 15/16* (2006.01)

(52) U.S. Cl. ..... 399/101; 399/44

(58) Field of Classification Search ..... 399/44, 399/31, 101, 99, 302, 308, 71, 66
See application file for complete search history.

(56) References Cited

U.S. PATENT DOCUMENTS 6,766,124 B2 * 7/2004 Taguchi et al. ..... 399/66

FOREIGN PATENT DOCUMENTS

JP 2002-182498 A 6/2002

* cited by examiner

*Primary Examiner* — David Porta
*Assistant Examiner* — Milton Gonzalez
(74) *Attorney, Agent, or Firm* — Buchanan Ingersoll & Rooney PC

(57) ABSTRACT

A toner image is formed on an image carrier using a toner supplied from a developing roller to which a controlled bias voltage is applied; the toner image is primarily transferred onto an intermediate transfer member; the toner image is secondarily transferred onto a recording sheet using a transfer voltage applied to the secondary transfer roller; and the bias voltage is applied to the secondary transfer roller as a cleaning voltage necessary for cleaning the secondary transfer roller; and the toner adhered to a circumferential surface of the secondary transfer roller is reversely transferred onto the intermediate transfer member.

16 Claims, 8 Drawing Sheets

FIG. 4

| BIAS VOLTAGE (Vdc) | Vdc < -700 | -700 ≦ Vdc < -600 | -600 ≦ Vdc ≦ -500 |
|---|---|---|---|
| CLEANING ROTATION NUMBER (c) | 3 | 5 | 7 |

FIG. 5

| ABSOLUTE TEMPERATURE AND HUMIDITY (A) | A ≦ 5 | 5 < A < 16 | A ≧ 16 |
|---|---|---|---|
| ADDITIONAL ROTATION NUMBER | +2 | 0 | +4 |

FIG. 6

| DEGREE OF TONER DETERIORATION (ELAPSE PERIOD/VALID PERIOD) | ≦ 0.8 | > 0.8 |
|---|---|---|
| ADDITIONAL ROTATION NUMBER | +4 | 0 |

IMAGE FORMING APPARATUS AND METHOD OF CLEANING SECONDARY TRANSFER ROLLER USED THEREIN

CROSS-REFERENCE TO RELATED APPLICATIONS

This application is based on application No. 2008-147734 filed in Japan, the contents of which are hereby incorporated by reference.

BACKGROUND OF THE INVENTION (1) Field of the Invention

The present invention relates to an image forming apparatus that primarily transfers a toner image onto an intermediate transfer member, and then secondarily transfers the toner image onto a recording sheet using a secondary transfer roller. The present invention particularly relates to an art for cleaning a circumferential surface of the secondary transfer roller.

(2) Related Art

An image forming apparatus employing a so-called intermediate transfer system performs image formation by primarily transferring a toner image formed on an image carrier onto an intermediate transfer member such as an intermediate transfer belt, and then secondarily transferring the toner image onto a recording sheet using a secondary transfer roller. According to such an image forming apparatus, a surface of the secondary transfer roller becomes stained because a toner adhered to a non-image area of the image carrier adheres to the surface of the secondary transfer roller via the intermediate transfer member, or a toner that has not been transferred onto a recording sheet due to, for example, a paper feeding error adheres to the surface of the secondary transfer roller.

If this stain on the surface of the secondary transfer roller is left unaddressed, a rear surface of the recording sheet will become stained, and it might occur that transfer efficiency decreases and as a result defective transfer is caused.

Accordingly, the above image forming apparatus regularly cleans the secondary transfer roller by applying a voltage having the same polarity as that of the toner to the secondary transfer roller, and reversely transferring the toner adhered to the surface of the secondary transfer roller onto the intermediate transfer member (See Japanese Laid-Open Patent Application Publication No. 2002-182498, for example).

Here, there has been conventionally used an image forming apparatus in which, for the purpose of reducing manufacturing costs thereof, a power supply of a developing bias voltage (hereinafter referred to simply as "bias voltage") is used for performing-cleaning of the secondary transfer roller instead of additionally providing a power supply apparatus dedicated to performing the cleaning.

Generally, in order to keep a constant toner concentration, a bias voltage is controlled by a known bias voltage control apparatus so as to be within a range of approximately −300 V to −700 V. When a bias voltage is applied to a secondary transfer roller in order to clean the secondary transfer roller as described above, the bias voltage control apparatus controls the bias voltage to be a voltage necessary for performing the cleaning (approximately −500 V).

By the way, it has been conventionally known that when an original bias voltage is controlled to be a voltage necessary for cleaning a secondary transfer roller, or when the voltage necessary for performing the cleaning is restored to the original voltage, this control of the voltage causes a phenomenon that a toner on a surface of a developing roller adheres to an image carrier. In order to prevent the adhered toner (hereinafter referred to as "fog toner") from being further transferred onto an intermediate transfer member and moving to a secondary transfer position, and as a result adhering to a surface of the secondary transfer roller, the following action is taken. The secondary transfer roller is kept separated from the surface of the intermediate transfer member till a part of the intermediate transfer member to which the fog toner has adhered passes by the secondary transfer position, and then an operation of cleaning the secondary transfer roller is performed.

However, according to the above conventional art, the fog toner needs to be caused to pass by the secondary transfer position before and after performing the cleaning operation. Accordingly, it is inevitably necessary to take periods for keeping the secondary transfer roller separated from the intermediate transfer member before and after performing the cleaning operation. This delays completion of the cleaning operation, and as a result, there occurs a problem that execution of subsequent image forming jobs always delays.

SUMMARY OF THE INVENTION

In view of the above problem, the present invention aims to provide an image forming apparatus and a method of cleaning a secondary transfer roller thereof that are capable of preventing unnecessary delay of operations of cleaning the secondary transfer roller in a case where the cleaning is performed using a shared a power supply of a developing bias, and promptly performing subsequent image formation operations.

In order to achieve the above aim, the image forming apparatus relating to the present invention includes: a bias voltage controller that controls a bias voltage to be applied to a developing roller; an image former that performs image formation by forming a toner image on an image carrier using a toner supplied from the developing roller to which the controlled bias voltage is applied, primarily transfers the toner image onto a running intermediate transfer member, and secondarily transfers the toner image onto a recording sheet using a transfer voltage applied to a secondary transfer roller; and a cleaner that cleans the secondary transfer roller by applying the bias voltage to the secondary transfer roller as a cleaning voltage necessary for cleaning the secondary transfer roller, and reversely transferring the toner adhered to a circumferential surface of the secondary transfer roller onto the intermediate transfer member, the cleaner comprising: a switcher operable to switch between electric paths such that the bias voltage is applied to the secondary transfer roller as the cleaning voltage, instead of the transfer voltage; an instruction part operable to, if a present absolute value of the bias voltage is less than a threshold value, instruct the bias voltage controller to control the absolute value so as to be no less than the threshold value; and a secondary transfer roller driver operable to, if the bias voltage controller receives the instruction by the instruction part and controls the absolute value, move the secondary transfer roller such that the secondary transfer roller is kept separated from the intermediate transfer member for a predetermined period, and if the bias voltage controller does not receive the instruction by the instruction part, keep the secondary transfer roller in pressure-contact with the intermediate transfer member.

Also, the cleaning method relating to the present invention that is used in an image forming apparatus includes: a bias voltage controller that controls a bias voltage to be applied to a developing roller; an image former that performs image formation by forming a toner image on an image carrier using a toner supplied from the developing roller to which the controlled bias voltage is applied, primarily transfers the toner image onto a running intermediate transfer member, and secondarily transfers the toner image onto a recording sheet using a transfer voltage applied to the secondary transfer roller; and a cleaner that cleans the secondary transfer roller by applying the bias voltage to the secondary transfer roller as a cleaning voltage necessary for cleaning the secondary transfer roller, and reversely transferring the toner adhered to a circumferential surface of the secondary transfer roller onto the intermediate transfer member, the cleaning method comprising: a switching step of switching between electric paths such that the bias voltage is applied to the secondary transfer roller as the cleaning voltage, instead of the transfer voltage; an instructing step of, if a present absolute value of the bias voltage is less than a threshold value, instructing the bias voltage controller to control the absolute value so as to be no less than the threshold value; and a secondary transfer roller driving step of, if the bias voltage controller receives the instruction by the instructing step and controls the absolute value, moving the secondary transfer roller such that the secondary transfer roller is kept separated from the intermediate transfer member for a predetermined period, and if the bias voltage controller does not receive the instruction by the instructing step, keeping the secondary transfer roller in pressure-contact with the intermediate transfer member.

In the image forming apparatus or the cleaning method, the predetermined period may correspond to a period that starts when a toner adhered to the image carrier due to the control of the absolute value is transferred onto the intermediate transfer member and ends when a part of the intermediate transfer member onto which the toner has been transferred passes by a transfer position of the secondary transfer roller by running of the intermediate transfer member.

Here, the image forming apparatus may further comprise a judgment part operable to judge whether the secondary transfer roller needs to be cleaned; and a controller operable to control operations of the image former, wherein if the judgment part judges affirmatively while the image former performs the image formation, and a toner image is primarily transferred onto the intermediate transfer member, the controller controls the image former so as to suspend the image forming operation after the toner image is secondarily transferred onto a recording sheet, and then restart the image forming operation after the cleaner completes cleaning of the secondarily transfer roller.

Also, the cleaning method may further comprise a judging step of judging whether the secondary transfer roller needs to be cleaned; and a controlling step of controlling operations of the image former, wherein if the judging step judges affirmatively while the image former performs the image formation, and a toner image is primarily transferred onto the intermediate transfer member, the controlling step controls the image former so as to suspend the image forming operation after the toner image is secondarily transferred onto a recording sheet, and then restarting the image forming operation after the cleaner completes cleaning of the secondarily transfer roller.

With the above structures, if an absolute value of a bias voltage is no less than a threshold value available as a voltage necessary for performing an operation of cleaning the secondary transfer roller, the bias voltage is used without changing an electric potential thereof. Accordingly, no fog toner occurs, and the secondary transfer roller does not need to be separated. As a result, it is possible to save a period necessary for performing the cleaning operation. Also, if a bias voltage having an absolute value greater than the above threshold value is applied to the secondary transfer roller, it is possible to exhibit a sufficient cleaning efficiency.

Also, if the instruction part instructs the bias voltage controller to control the absolute value of the bias voltage so as to be no less than the threshold value, the instruction part may further instruct the bias voltage controller to, after the cleaner completes cleaning of the secondary transfer roller, restore the controlled bias voltage to the bias voltage that has been used till the reception of the instruction, and if the bias voltage controller restores the bias voltage, the secondary transfer roller driver may keep the secondary transfer roller separated from the intermediate transfer member for the predetermined period.

Also, if the instructing step instructs the bias voltage controller to control the absolute value of the bias voltage so as to be no less than the threshold value, the instructing step may further instruct the bias voltage controller to, after the cleaner completes cleaning of the secondary transfer roller, restore the controlled bias voltage to the bias voltage that has been used till the reception of the instruction, and if the bias voltage controller restores the bias voltage, the secondary transfer roller driving step may keep the secondary transfer roller separated from the intermediate transfer member for the predetermined period.

With the above structures, if an absolute value of a bias voltage is no less than a threshold value available as a voltage necessary for performing an operation of cleaning the secondary transfer roller, the instruction part does not instruct the bias voltage controller to control the absolute value of the bias voltage so as to be no less than the threshold value, and as a result the bias voltage controller does not perform restoration of the bias voltage. Accordingly, it is unnecessary to separate the secondary transfer roller after the cleaning operation completes. It is possible to promptly restart subsequent image forming jobs compared with a case where the absolute value of the bias voltage is less than the above threshold value.

Also, the cleaner may further comprise: a detector operable to detect temperature and/or humidity within the image forming apparatus; and a changer operable to change a period necessary for cleaning the secondary transfer roller in accordance with the temperature and/or humidity detected by the detector.

Also, the cleaning method may further comprise a detection step of detecting temperature and/or humidity within the image forming apparatus; and a changing step of changing a period necessary for cleaning the secondary transfer roller in accordance with the temperature and/or humidity detected by the detection step.

With the above structures, when electrification property of toners varies in accordance with temperature and humidity within the image forming apparatus, and as a result an amount of toners that adhere to the circumferential surface of the secondary transfer roller varies, it is possible to optimize a period for performing the cleaning operation in accordance with the variation of the amount of adhered toners. This increases the cleaning effects.

Also, the cleaner may further comprise: a deterioration, state acquisition part operable to acquire information relating to a deterioration state of the toner; and a changer operable to change an amount corresponding to a period necessary for cleaning the secondary transfer roller in accordance with the information relating to the deterioration state acquired by the deterioration state acquisition part.

Also, the cleaning method may further comprise a deterioration state acquiring step of acquiring information relating to a deterioration state of the toner; and a changing step of changing an amount corresponding to a period necessary for cleaning the secondary transfer roller in accordance with the information relating to the deterioration state acquired by the deterioration state acquiring step.

With the above structures, when electrification property of toners varies in accordance with the degree of toner deterioration, and as a result an amount of toners that adhere to the circumferential surface of the secondary transfer roller varies, it is possible to optimize a period for performing the cleaning operation in accordance with the variation of the amount of adhered toners. This increases the cleaning effects.

Also, the cleaner may clean the circumferential surface of the secondary transfer roller to which the toner has been adhered by alternately switching a voltage to be applied to the secondary transfer roller between the bias voltage as the cleaning voltage and the transfer voltage.

With the above structures, even if a reversely charged toner adheres to the secondary transfer roller, it is possible to reversely transfer the adhered toner onto the intermediate transfer member. This increases the cleaning effects.

BRIEF DESCRIPTION OF THE DRAWINGS

These and other objects, advantages and features of the invention will become apparent from the following description thereof taken in conjunction with the accompanying drawings those illustrate a specific embodiments of the invention. In the drawings:

FIG. 4 shows an example of a cleaning rotation number determination table;

FIG. 5 shows an example of a temperature and humidity based correction table;

FIG. 6 shows an example of a toner deterioration based correction table;

DESCRIPTION OF PREFERRED EMBODIMENTS

The following describes an embodiment of an image forming apparatus relating to the present invention, taking a tandem-type full-color image forming apparatus (hereinafter referred to simply as "image forming apparatus") as an example.

(1) Whole Structure of Image Forming Apparatus

Figure 1:
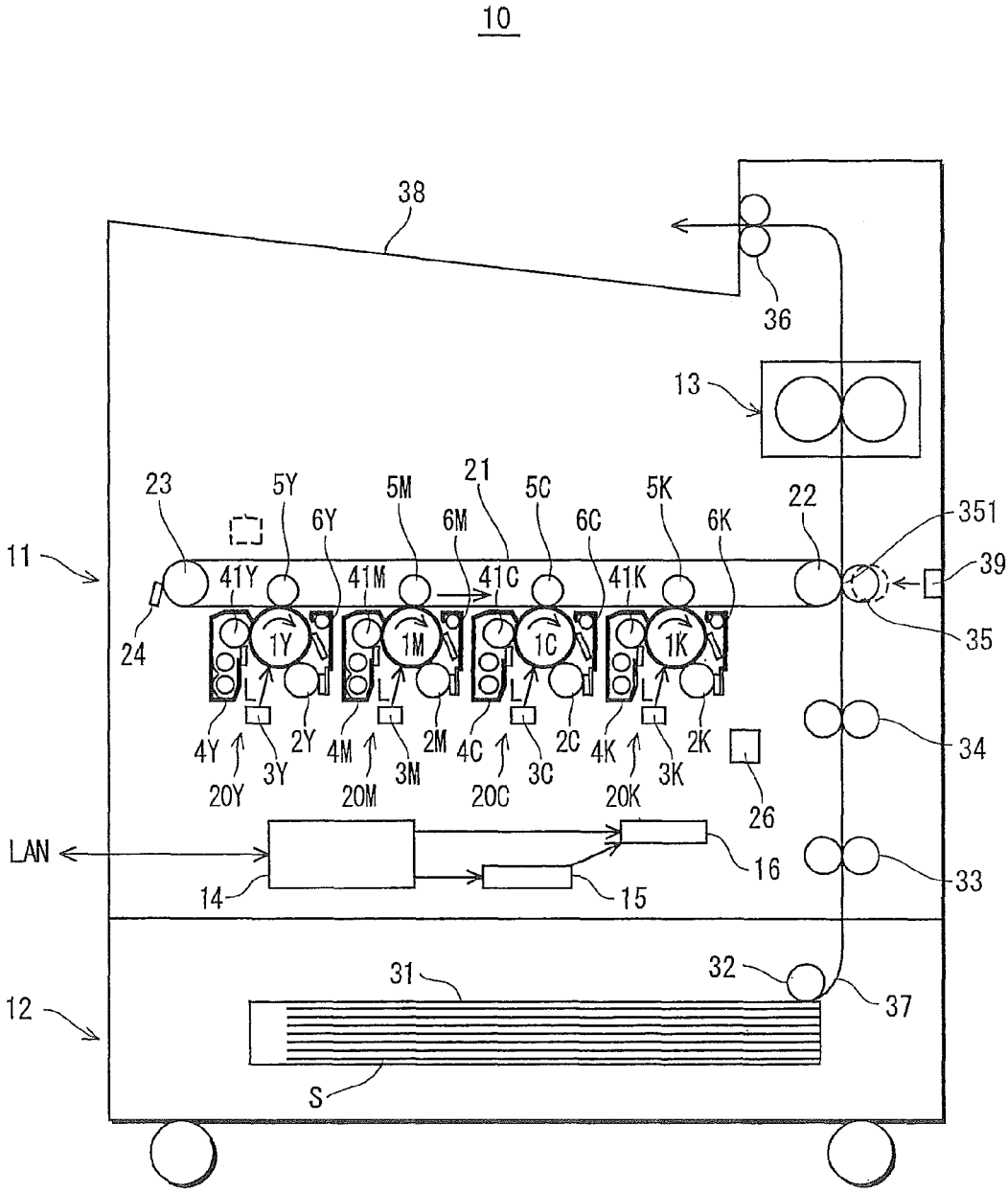
FIG. 1 shows the whole structure of an image forming apparatus 10.

FIG. 1 shows the whole structure of an image forming apparatus 10 relating to the embodiment.

As shown in FIG. 1, the image forming apparatus 10 forms an image in accordance with a well-known electrophotographic system, and includes an image process unit 11, a paper feed unit 12, a fixing unit 13, and a control unit 14. When being connected to a network (for example LAN) and receiving an instruction to execute a print job from an external terminal apparatus (not shown in the figure), the image forming apparatus 10 forms a color image composed of colors of yellow, magenta, cyan, and black in accordance with the received instruction.

Hereinafter, reproduced colors of yellow, magenta, cyan, and black are represented as Y, M, C, and K, respectively. Names of compositional elements relating to these reproduced colors have attached thereto alphabets of Y, M, C, and K, respectively.

The image process unit 11 includes image forming units. 20Y, 20M, 20C, and 20K respectively corresponding to colors of Y-K that are arranged in rows beneath an intermediate transfer belt 21 stretching and laying on a driving roller 22 and a driven roller 23.

The image forming units 20Y-20K respectively include photosensitive drums 1Y-1K, chargers 2Y-2K, exposing units 3Y-3K, developers 4Y-4K, primary transfer rollers 5Y-5K, cleaners 6Y-6K for cleaning the photosensitive drums 1Y-1K, and the like. The chargers 2Y-2K, the exposing units 3Y-3K, the developers 4Y-4K, the primary transfer rollers 5Y-5K, and the cleaners 6Y-6K are all respectively disposed at the circumference of the image forming units 20Y-20K.

The developers 4Y-4K respectively have provided therein developing rollers 41Y-41K for supplying toners to the photosensitive drums 1Y-1K. The developing bias power supply unit 15 applies a bias voltage separately to the developing rollers 41Y-41K.

This bias voltage is automatically controlled in accordance with temperature and humidity within the image forming apparatus 10 that are detected by a temperature and humidity sensor 26, as described later.

The developers 4Y-4K are respectively unitized, and can be attached/detached to/from the main body of the image forming apparatus 10. The developers 4Y-4K each have attached thereto an IC tag having recorded therein date information that indicates a manufacture date and a valid period of toners.

According to the image process unit 11 having such structure described above, a black toner image is formed on the photosensitive drum 1K in the following manner, for example. The photosensitive drum 1K is uniformly charged by the charger 2K, and is exposure-scanned by a laser beam L emitted from the exposing unit 3K to form an electrostatic latent image. Then, atoner is supplied from the developing roller 41K of the developer 4K, and the electrostatic latent image is developed into a black toner image. The formed black toner image is primarily transferred onto the intermediate transfer belt 21 due to an electrostatic force acting between the primary transfer roller 5K and the photosensitive drum 1K.

The image forming units 20Y, 20M, and 20 respectively form toner images of corresponding colors in the same manner as above. Note that the image formation operations of the respective colors are performed at predetermined intervals such that all the toner images of the respective colors are transferred and superimposed on top of one another at the same position on the intermediate transfer belt 21.

The paper feed unit 12 has a function of feeding a recording sheet S such as a transfer sheet to a secondary transfer position 351, and includes a paper feed cassette 31 for housing therein pieces of the recording sheets S, a supply roller 32 for supplying the recording sheets S housed in the paper feed cassette 31 to a paper path 37 piece by piece, an intermediate conveying roller pair 33, and a timing roller pair 34 for adjusting a timing of sending the recording sheet S out to the secondary transfer position 351.

In accordance with the timing of forming the above toner image, a recording sheet S is fed from the paper feed unit 12 to the secondary transfer position 351. The toner image on the intermediate transfer belt 21 is secondarily transferred onto the recording sheet S due to an electrostatic force acting between the secondary transfer roller 35 and the driving roller 22, to which a predetermined transfer voltage has been applied by the secondary transfer power unit 16. The toner image is heated and fixed to the recording sheet S by the fixing unit 13, and then is ejected on an eject tray 38 via an eject roller 36.

Figure 2:
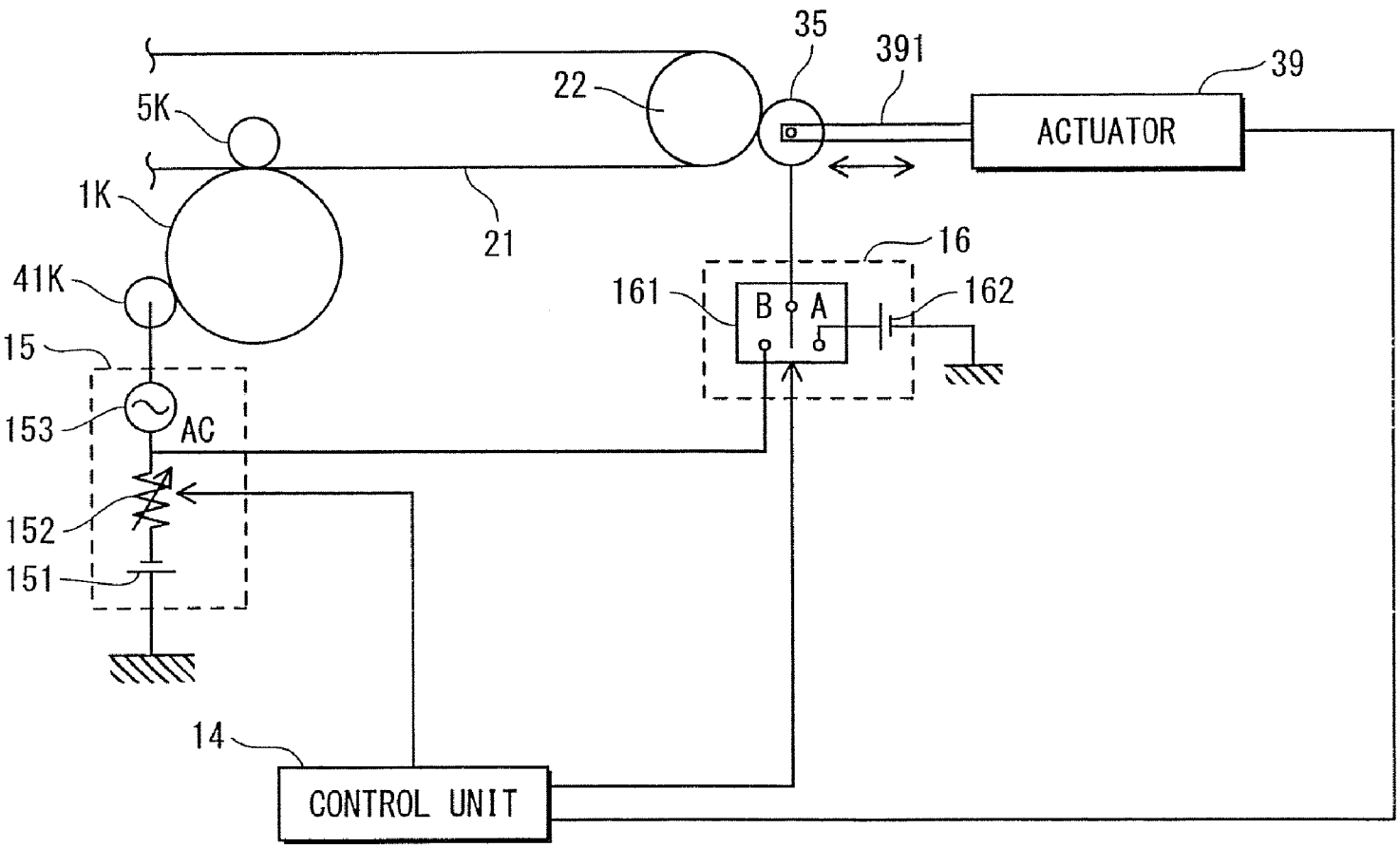
FIG. 2 shows the structure of an image forming unit 20K of black color, main compositional elements provided adjacent to a secondary transfer roller 35, a developing bias power supply unit 15, and a secondary transfer power unit 16 that are included in the image forming apparatus 10.

FIG. 2 shows the structure of the image forming unit 20K of black color, main compositional elements provided adjacent to the secondary transfer roller 35, the developing bias power supply unit 15, and the secondary transfer power unit 16 that are included in the image forming apparatus 10.

As shown in FIG. 2, the developing bias power supply unit 15 includes a DC power supply 151, a variable resistor 152, and an AC power supply 153 that are connected in series, and applies a bias voltage including an alternating-current component superimposed on a DC voltage to the developing roller 41K. The variable resistor 152 is well-known, and is structured such that a resistance value thereof is changed under control of the control unit 14. In accordance with variation in the resistance value, a voltage of a DC component to be applied to the developing roller 41K is controlled.

Also, the secondary transfer power unit 16 includes a change-over switch 161 and a positive DC power supply 162. In order to perform the image formation operation, the secondary transfer power unit 16 operates the change-over switch 161 under control of the control unit 14 such that the secondary transfer roller 35 is connected to the DC power supply 162, and applies a transfer voltage to the secondary transfer roller 35. Also, in order to perform the operation of cleaning the secondary transfer roller 35 is performed, the secondary transfer power unit 16 operates the change-over switch 161 under control of the control unit 14 such that the secondary transfer roller 35 is connected to the DC power supply 151 of the developing bias power supply unit 15, and applies a bias voltage having the opposite polarity to that of the transfer voltage to the secondary transfer roller 35.

The secondary transfer roller 35 is pivoted at one end of a drive rod 391 of an actuator 39 so as to be rotatable. When the image formation operation is performed, the secondary transfer roller 35 is driven such that a circumferential surface thereof is brought into pressure-contact with a circumferential surface of the intermediate transfer belt 21. Also, when the operation of cleaning the secondary transfer roller 35 is performed, the secondary transfer roller 35 is driven so as to separate from the intermediate transfer belt 21 in accordance with a predetermined timing. As this actuator 39, a solenoid, a direct driving motor or the like is used. Alternatively, an eccentric cam may be used.

The operation of cleaning the secondary transfer roller 35 is described in detail later.

(2) Structure of Control Unit 14

Figure 3:
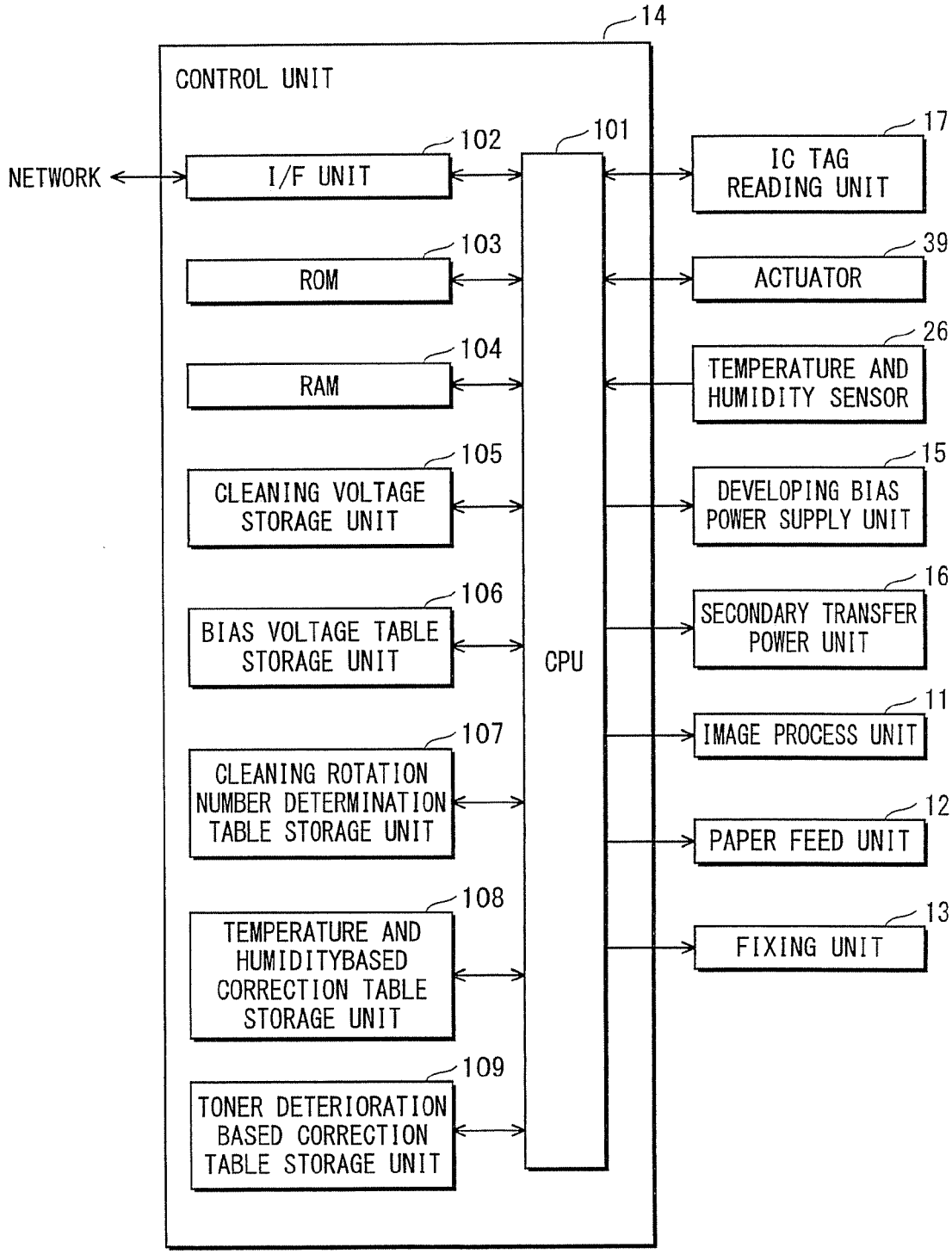
FIG. 3 is a block diagram showing the structure of a control unit 14.

FIG. 3 is a block diagram showing the structure of the control unit 14.

As shown in FIG. 3, the control unit 14 includes, as main compositional elements, a CPU 101, a communication interface (I/F) unit 102, a ROM 103, a RAM 104, a cleaning voltage storage unit 105, a bias voltage table storage unit 106, a cleaning rotation number determination table storage unit 107, a temperature and humidity based correction table storage unit 108, a toner deterioration based correction table storage unit 109, and the like.

The communication I/F unit 102 is an interface for connecting to LAN such as a LAN card and a LAN board.

The ROM 103 has stored therein programs necessary for performing the image forming operation, programs necessary for performing the operation of cleaning the secondary transfer roller 35, threshold values to be used for control, and so on.

The RAM 104 is used as a work area when the CPU 101 executes the programs.

The cleaning voltage storage unit 105 stores therein a bias voltage to be applied as a voltage necessary for performing the cleaning operation upon switching of electric paths. Hereinafter, this bias voltage is referred to as "cleaning voltage". The cleaning voltage storage unit 105 also stores therein the number of rotations of the secondary transfer roller 35 that is necessary for performing the cleaning operation by applying the cleaning voltage to the secondary transfer roller 35.

Hereinafter, the number of rotations of the secondary transfer roller 35 that is necessary for cleaning the secondary transfer roller 35 is referred to as "cleaning rotation number".

The bias voltage table storage unit 106 stores therein a bias voltage table showing the correspondence between temperature and humidity within the image forming apparatus 10 and bias voltage to be applied to the developing rollers 41Y-41K.

The cleaning rotation number determination table storage unit 107 stores therein a cleaning rotation number determination table showing the correspondence between bias voltage (Vdc) to be applied as the cleaning voltage and the cleaning rotation number.

FIG. 4 shows an example of the cleaning rotation number determination table that is applied under normal room temperature. According to this table, a greater absolute value of a bias voltage exhibits a higher cleaning effect. Accordingly, the cleaning rotation number (c) is determined so as to decrease as the absolute value of the bias voltage increases. In this example, when the cleaning voltage in a range of $Vdc < -700$, the cleaning rotation number (c) is determined to be three. When the cleaning voltage in a range of $-700 \leqq Vdc \leqq -600$, the cleaning rotation number (c) is determined to be five. When the cleaning voltage in a range of $-600 \leqq Vdc \leqq -500$, the cleaning rotation number (c) is determined to be seven.

The temperature and humidity based correction table storage unit 108 stores therein a temperature and humidity based correction table showing the correspondence between temperature and humidity within the image forming apparatus 10 and the additional cleaning rotation number to be added to the original cleaning rotation number.

FIG. 5 shows an example of the above temperature and humidity based correction table. According to this table, an additional cleaning rotation number is added when low temperature and low humidity (absolute humidity of no more than 5 $g/m^3$) are detected and when high temperature and high humidity (absolute humidity of no less than 16 $g/m^3$) are detected. In this example, when absolute humidity (A $g/m^3$) is in a range of $A \leqq 5$, an additional cleaning rotation number is determined to be two. Also, when absolute humidity (A $g/m^3$) is in a range of $A \geqq 16$, an additional cleaning rotation number is determined to be four.

The toner deterioration based correction table storage unit 109 stores therein a toner deterioration based correction table showing the correspondence between the degree of toner deterioration and the additional cleaning rotation number to be added to the original cleaning rotation number of the secondary transfer roller 35.

Here, the "degree of toner deterioration" represents the average of ratios of periods lapsed from manufacture dates of toners respectively held in the developers 4Y-4K to valid periods of the toners.

Also, FIG. 6 shows an example of the above toner deterioration based correction table. According to this table, when a degree of toner deterioration is no less than 0.8, an additional cleaning rotation number is added. In this example, when a degree of toner deterioration is no less than 0.8, an additional cleaning rotation number to be added is four.

The CPU 101 reads a necessary control program from the ROM 103. The CPU 101 controls a, bias voltage to be applied to the developing rollers 41Y-41K based on temperature and humidity detected by the temperature and humidity sensor 26, and also controls the image process unit 11, the paper feed unit 12, the fixing unit 13, and the like to smoothly perform image forming operation. Also, when a predetermined time has come for cleaning the secondary transfer roller 35, the CPU 101 controls the change-over switch 161 of the electric path of the secondary transfer power unit 16, and controls driving of the developing bias power supply unit 15 and the actuator 39 if necessary based on the size of the bias voltage, in order to perform an operation of cleaning the secondary transfer roller 35.

(3) Operations of Cleaning Secondary Transfer Roller

The following describes an operation of cleaning the secondary transfer roller 35 performed by the control unit 14.

Figure 7:
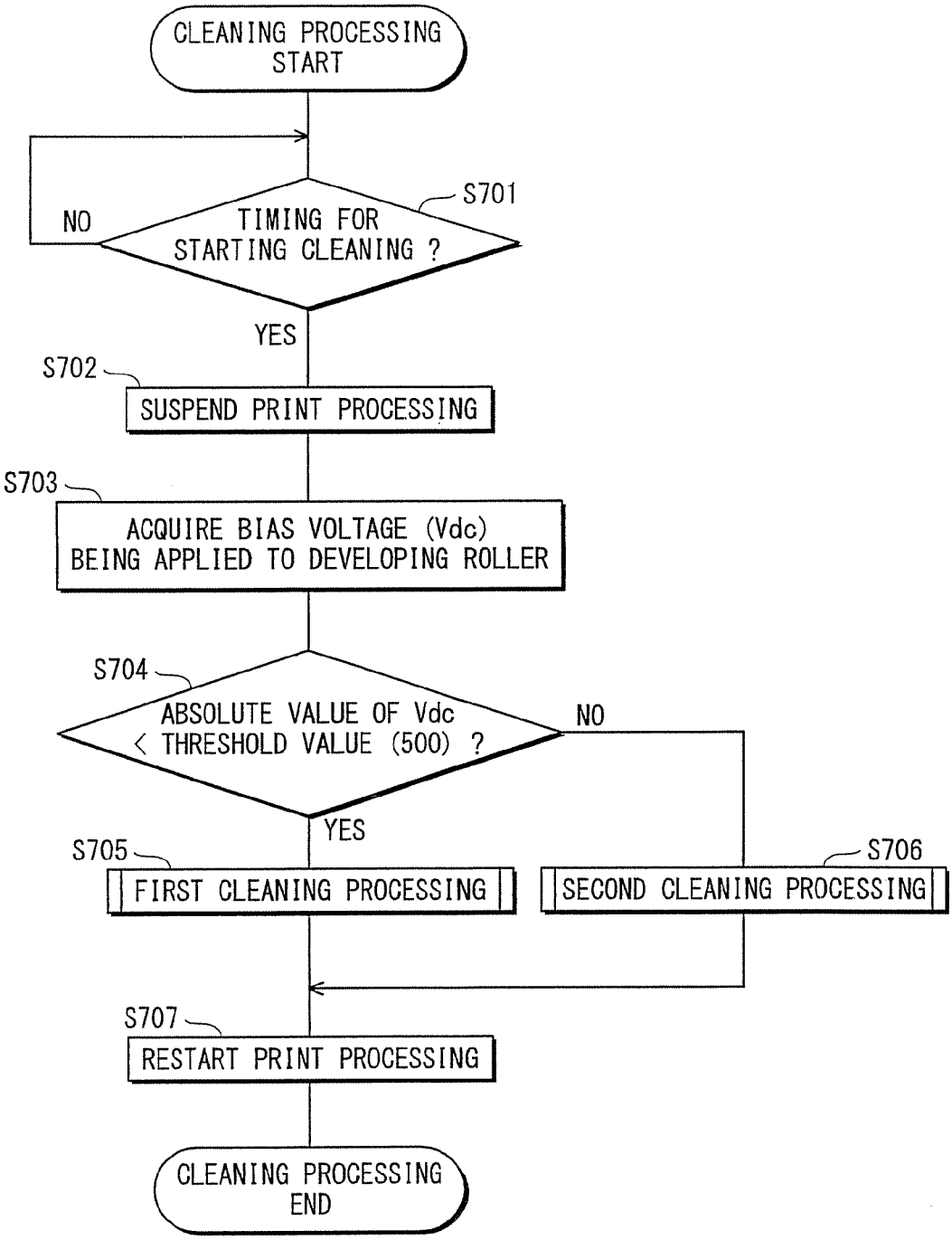
FIG. 7 is a flow chart showing an operation of cleaning processing performed by the control unit 14.

FIG. 7 is a flow chart showing the cleaning operation.

When starting print processing, the control unit 14 counts the number of printed sheets. When the number of printed sheets reaches a predetermined number, the control unit 14 judges that a timing for starting cleaning has come (Step S701: YES), and suspends the print processing (Step S702). At this time, when a formed toner image is on the intermediate transfer belt 21, it is desirable to secondarily transfer the toner image onto a recording sheet S, and fix the toner image to the recording sheet S, and then suspend the print processing. Note that the predetermined number corresponds to for example 150 counts in a case where A4 size sheets that are horizontally fed are used as recording sheets, one piece of color printed sheet of A4 horizontal size is counted as two, and one piece of monochrome printed sheet of A4 horizontal size is counted as one.

Then, the control unit 14 acquires a bias voltage (Vdc) currently being applied to the developing roller 41K at this time (Step S703), and judges whether an absolute value of Vdc is less than a predetermined threshold value (Step S704).

This threshold value is calculated in advance by experiments or the like, as a value that can provide the secondary transfer roller 35 with a sufficient cleaning effect. In the embodiment, the threshold value is determined to be "500", and is stored in the ROM 103.

Note that control of bias voltage is well known, and is performed by the CPU 101. Specifically, based on temperature and humidity detected by the temperature and humidity sensor 26, the CPU 101 controls the developing bias power supply unit 15 such that a bias voltage has an appropriate value, with reference to a table (not shown in the figure) stored in the bias voltage table storage unit 106. In the embodiment, the bias voltage is controlled to be in a range of 700 V to −300 V.

The bias voltage is controlled based on temperature and humidity as described above. This is because, in order to perform appropriate development, it is desirable that a difference in bias voltage between a surface of the photosensitive drum and the developing roller is within a predetermined range, and also a charged state of the photosensitive drum is greatly influenced by the temperature and humidity within the image forming apparatus. Alternatively, it may be possible-to directly detect a bias voltage of the surface of the photosensitive drum so as to control the bias voltage. Further alternatively, it may be possible to regularly form a toner patch on the surface of the photosensitive drum, detect a concentration of the toner patch, and control a bias voltage such that the detected concentration is equal to a predetermined concentration.

If the absolute value of the Vdc is less than the predetermined threshold value (Step S704: YES), the control unit 14 performs first cleaning processing (Step S705). If the absolute value of the Vdc is no less than the predetermined threshold value (Step S704: NO), the control unit 14 performs second cleaning processing (Step S706). After performing Step S705 or Step S706, the control unit 14 restarts the print processing (Step S707).

Figure 8:
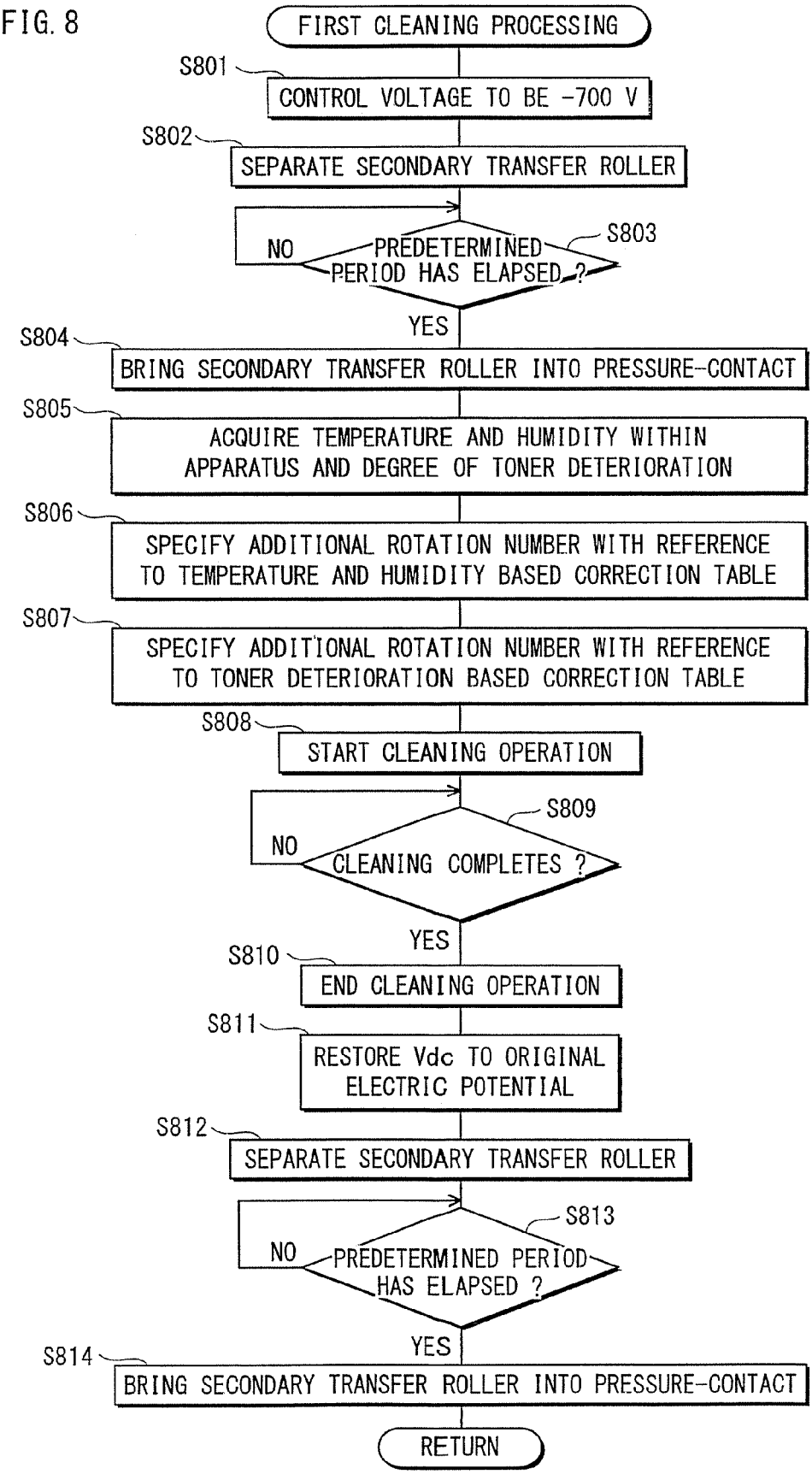
FIG. 8 is a flow chart showing control in first cleaning processing performed in Step S705.

FIG. 8 is a flow chart showing control of the first cleaning processing in Step S705.

Firstly, the control unit 14 reads a cleaning voltaege and a cleaning rotation number from the cleaning voltage storage unit 105, and controls the variable resistor 152 of the developing bias power supply unit 15 such that an absolute value of the bias voltage (Vdc) is equal to the cleaning voltage (set to be −700 V here) (Step S801). Also, the control unit 14 separates the secondary transfer roller 35 from the intermediate transfer belt 21 (Step S802). After a predetermined period has elapsed (Step S803: YES), the control unit 14 brings the secondary transfer roller 35 into pressure-contact with the intermediate transfer belt 21 (Step S804).

The secondary transfer roller 35 is separated in order to prevent the secondary transfer roller 35 from being stained with a toner adhered to the intermediate transfer belt 21 due to change of the bias voltage.

That is, when the Vdc changes in Step S801, a phenomenon often occurs that a toner on a surface of the developing roller 41K jumps to a surface of the photosensitive drum 1K. This phenomenon is a so called "toner fog". If the secondary transfer roller 35 is still being in pressure-contact with the intermediate transfer belt 21 while this toner (hereinafter referred to as "fog toner") is transferred onto a, part of the intermediate transfer belt 21 and the part of the intermediate transfer belt 21 to which the fog toner adheres passes by the secondary transfer position 351, the secondary transfer roller 35 becomes stained with the toner adhered thereto. In order to prevent this, the secondary transfer roller 35 is kept separated from the intermediate transfer belt 21 till the part of the intermediate transfer belt 21 to which the fog toner adheres passes by the secondary transfer position 351.

Accordingly, the predetermined period to be waited in Step S803 is from a time when the bias voltage is controlled in Step S801 to a time when the part of the intermediate transfer belt 21 to which the fog toner adheres passes by the secondary transfer position 351. This predetermined period is calculated in advance, and is stored in the ROM 103.

After the part of the intermediate transfer belt 21 to which the fog toner adheres passes by the secondary transfer position 351, the fog toner is removed by a cleaning blade 24 (see FIG. 1).

In Step S805, the control unit 14 acquires temperature and humidity within the image forming apparatus 10 from the temperature and humidity sensor 26, and acquires pieces of date information respectively recorded in the IC tags of the developers 4Y-4K via the IC tag reading unit 17. With respect to each of the developers 4Y-4K, the control unit 14 compares the acquired piece of date information with a present time, and calculates a lapse period based on a manufacture date, and further calculates a degree of toner deterioration based on the calculated lapse period and a valid period indicated by the piece of date information (Step S805).

Furthermore, the control unit 14 specifies an additional cleaning rotation number corresponding to the acquired temperature and humidity, with reference to the temperature and humidity based, correction table stored in the temperature and humidity based correction table storage unit 108 (Step S806). Also, the control unit 14 specifies an additional cleaning rotation number corresponding to the calculated degree of toner deterioration, with reference to the toner deterioration based correction table stored in the toner deterioration based correction table storage unit 109 (Step S807).

The control unit 14 adds the additional cleaning rotation numbers respectively specified in Steps S806 and S807 to the cleaning rotation number read in Step S801, and determines the cleaning number to which the additional cleaning rotation numbers have been added, as a final cleaning rotation number. The control unit 14 applies the cleaning voltage controlled in Step S801 to the secondary transfer roller 35, and starts a cleaning operation (Step S808). Then, the control unit 14 monitors whether the cleaning operation completes (Step S809). Specifically, the control unit 14 judges whether a period necessary for performing rotation corresponding to the determined final cleaning rotation number has elapsed by activating the timer.

When the rotation corresponding to the final cleaning rotation number completes (Step S809: YES), the control unit 14 ends the cleaning operation (Step S810), and restores the bias voltage (Vdc) to the original voltage, which has been used till the control by the control unit in Step S801 (Step S811). Furthermore, the control unit 14 separates the secondary transfer roller 35 from the intermediate transfer belt 21 (Step S812). After a predetermined period has elapsed (Step S813: YES), the secondary transfer roller 35 is brought into pressure-contact with the intermediate transfer belt 21 (Step S814). Note that the predetermined period is from a time when the bias voltage is restored in Step S811 to a time when the part of the intermediate transfer belt 21 to which the fog toner due to the restoration adheres passes by the secondary transfer position.

Figure 9:
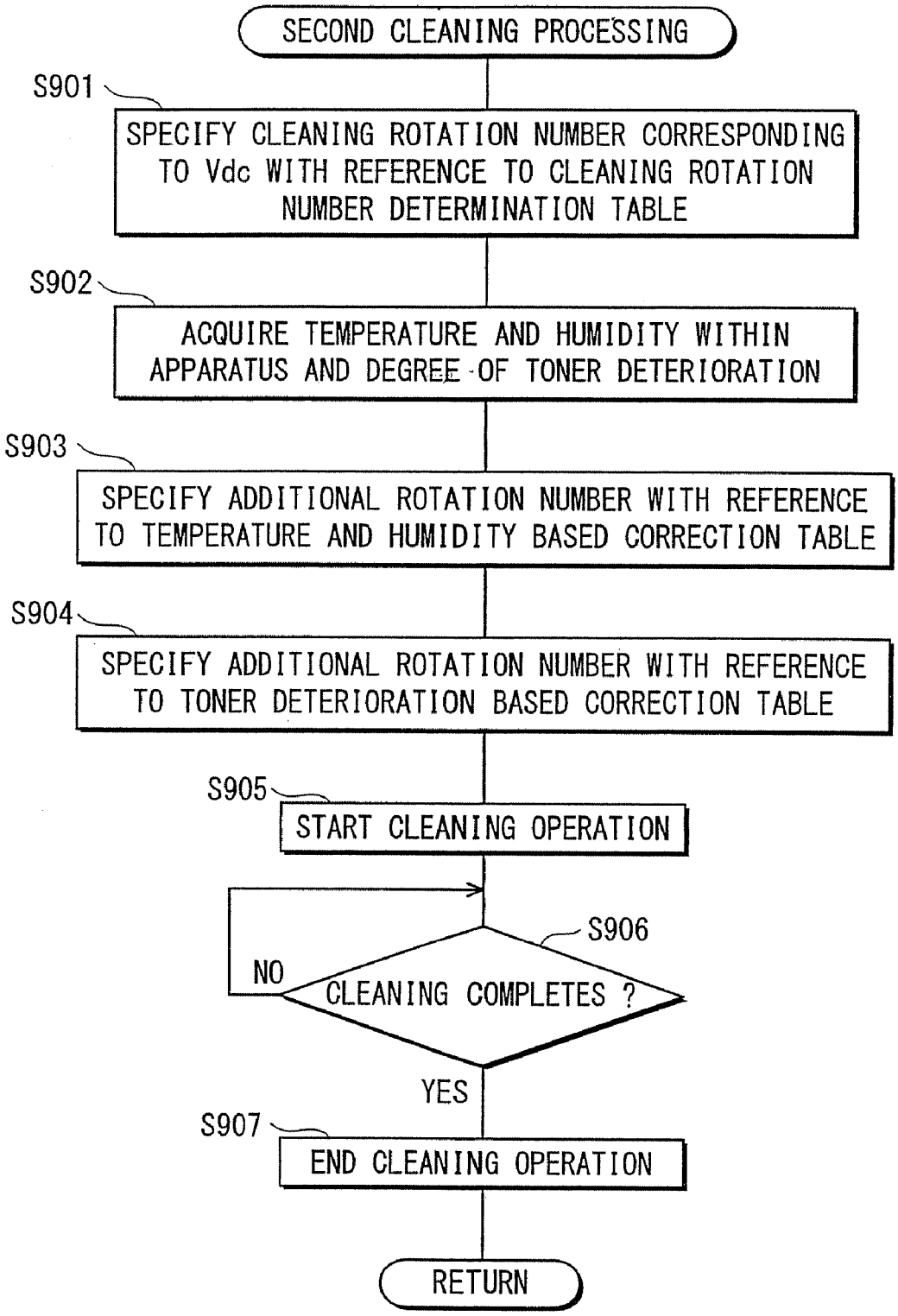
FIG. 9 is a flow chart showing control in second cleaning processing performed in Step S706.

FIG. 9 is a flow chart showing control of the second cleaning processing in Step S706.

Firstly, the control unit 14 reads the cleaning rotation number determination table from the cleaning rotation number determination table storage unit 107, and specifies a cleaning rotation number corresponding to the bias voltage (Vdc) with reference to the cleaning rotation number determination table (Step S901). Furthermore, the control unit 14 acquires temperature and humidity within the image forming apparatus 10 from the temperature and humidity sensor 26, and acquires the pieces of date information respectively recorded in the IC tags of the developers 4Y-4K, and calculates a degree of toner deterioration in the same manner as that in Step 805 in FIG. 8 (Step S902).

Furthermore, the control unit 14 specifies an additional cleaning rotation number corresponding to the acquired temperature and humidity with reference to the temperature and humidity based correction table stored in the temperature and humidity based correction table storage unit 108 (Step S903). Then, the control unit 14 specifies an additional cleaning rotation number corresponding to the calculated degree of toner deterioration with reference to the toner deterioration based correction table stored in the toner deterioration based correction table storage unit 109 (Step S904).

The control unit 14 adds the additional cleaning rotation numbers respectively specified in Steps S903 and S904 to the cleaning rotation number specified in Step S901, and determines the cleaning number to which the additional cleaning rotation numbers have been added, as a final cleaning rotation number. The control unit 14 starts a cleaning operation (Step S905). Then, the control unit 14 monitors whether the cleaning operation completes (Step S906). Specifically, the control unit 14 judges whether a period necessary for performing rotation corresponding to the determined final cleaning rotation number by activating the timer. When the rotation corresponding to the final cleaning rotation number completes (Step S906: YES), the control unit 14 ends the cleaning operation (Step S907).

Figure 10:
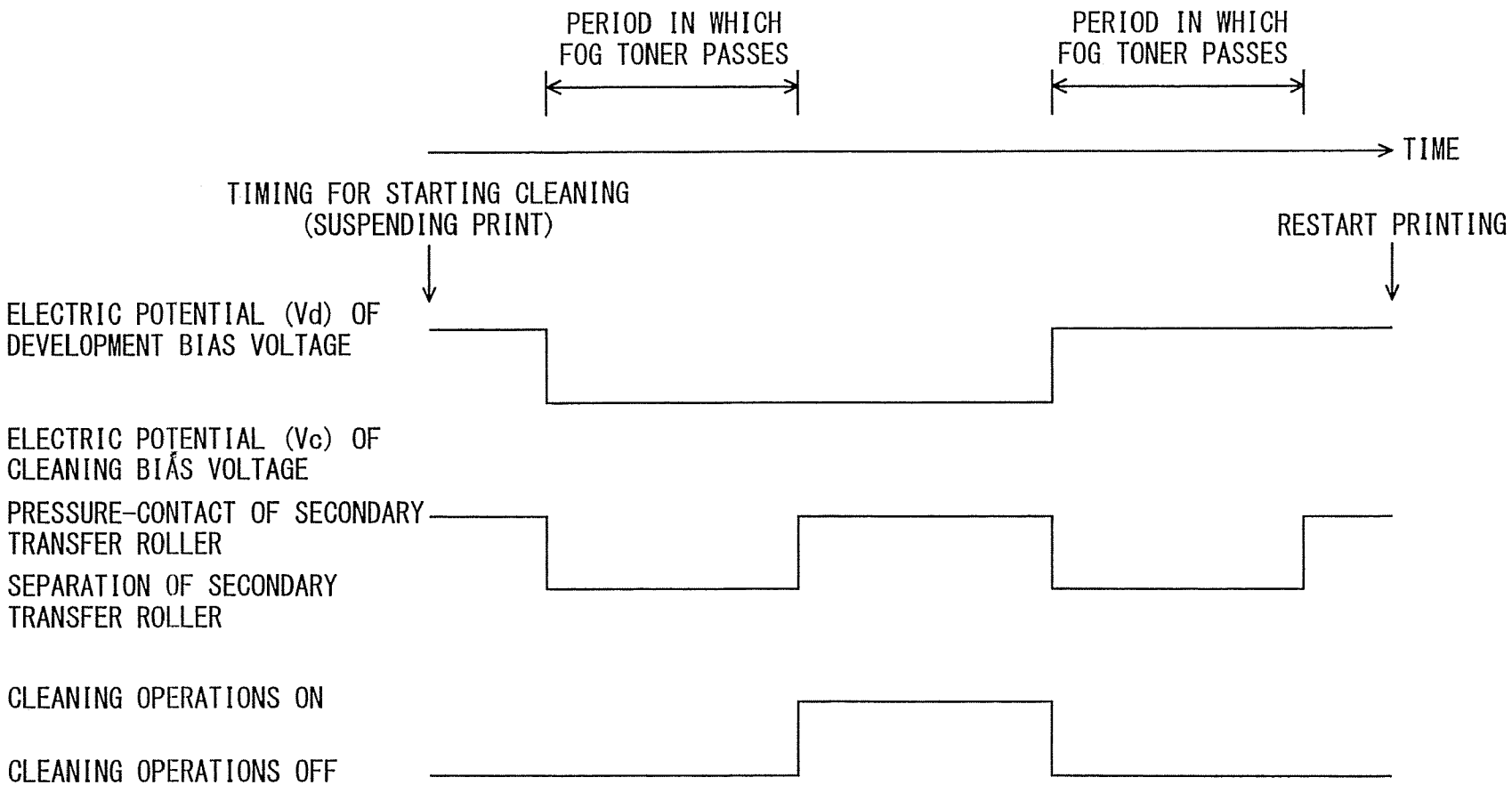
FIG. 10 is a time chart of the first cleaning processing.

FIG. 10 is a time chart of the first cleaning processing. As shown in FIG. 10, when a predetermined timing has come for cleaning the secondary transfer roller 35 while print processing is being performed, the control unit 14 suspends the print processing, and switches a bias voltage to be applied from a voltage for performing development (Vd) to a cleaning voltage (Vc). The control unit 14 keeps the secondary transfer roller 35 separated from the intermediate transfer belt 21 till a fog toner generated due to the switch of the bias voltage is transferred onto the intermediate transfer belt 21 and the part of the intermediate transfer belt 21 to which the fog toner adheres passes by the secondary transfer position. Then, the control unit 14 brings the secondary transfer roller 35 into pressure-contact with the intermediate transfer belt 21, and starts an operation of cleaning the secondary transfer roller 35.

Then, after completing the cleaning operation, the control unit 14 switches a bias voltage to be applied from the cleaning voltage (Vc) to the bias voltage necessary for performing development (Vd) that has been immediately previously used. The control unit 14 keeps the secondary transfer roller 35 separated from the intermediate transfer belt 21 till the fog toner is transferred onto the intermediate transfer belt 21 and the part of the intermediate transfer belt 21 to which the fog toner adheres passes by the secondary transfer position 351. Then, the control unit 14 brings the secondary transfer roller 35 into pressure-contact with the intermediate transfer belt 21, and restarts the print processing.

As described above, according to the first cleaning processing, as is conventionally done, it is necessary to have periods for keeping the secondary transfer roller separated from the intermediate transfer member before and after the operation of cleaning the secondary transfer roller in order to cause the part of the intermediate transfer member to which the fog toner adheres passes by the secondary transfer position. As a result, completion of the cleaning operation will delay.

Compared with this, according to the second cleaning processing, since the bias voltage is used as a cleaning voltage without changing an electric potential thereof, no fog toner is generated while the secondary transfer roller is cleaned. Accordingly, it is unnecessary to separate the secondary transfer roller from the intermediate transfer member. This makes it possible to save a period for performing processing of cleaning the secondary transfer roller.

Therefore, if an absolute value of a bias voltage used for performing an image forming job is no less than a threshold value available as a cleaning voltage, and processing of cleaning the secondary transfer roller is performed in accordance with the second cleaning processing, it is possible to promptly complete the cleaning processing compared with conventional cleaning methods. Also, it is possible to shorten a period in which print processing cannot be performed, and as a result to increase the printing efficiency.

<Supplementary Explanation>

Although the image forming apparatus relating to the present invention has been described based on the above embodiment, the present invention is not of course limited to this embodiment, and further includes the following modifications, for example.

(1) In the above embodiment, cleaning processing is performed by suspending print processing. However, a timing for performing the cleaning processing relating to the above embodiment is not limited to be included in while the print processing is performed. Alternatively, it may be possible to perform the cleaning processing for example when the power is activated, when a jam occurs, when the print processing has not been started, or the like.

(2) In the above embodiment, the cleaning rotation number is corrected by detecting both of temperature and humidity within the image forming apparatus. Alternatively, it may be possible to perform the correction by detecting either one of temperature and humidity. In this case, the following may be impossible. For example, instead of the temperature and humidity based correction table, the temperature and humidity based correction table storage unit 108 stores therein a table showing the correspondence between the additional cleaning rotation number of the secondary transfer roller 35 and either one of temperature and humidity. Accordingly, it is possible to correct the cleaning rotation number in accordance with either one of temperature and humidity within the image forming apparatus.

(3) In the above embodiment, the operation of cleaning the secondary transfer roller 35 is performed by applying a bias voltage necessary for performing cleaning having the opposite polarity to that of the transfer voltage. Alternatively, it maybe possible to perform the cleaning operation by alternately applying the bias voltage necessary for cleaning and a transfer voltage. According to this, even if a reversely charged toner is transferred onto the secondary transfer roller 35, it is possible to move the reversely charged toner to the intermediate transfer belt 21, thereby increasing the cleaning effects.

(4) In the above embodiment, the cleaning rotation number of the secondary transfer roller 35 is corrected based on temperature and humidity within the image forming apparatus and a degree of toner deterioration. Alternatively, it may be possible to perform the correction based on either one of the temperature and humidity and the degree of toner deterioration. Furthermore, it may be possible to exhibit the effects of the present invention without performing the correction based on the temperature and humidity or the degree of toner deterioration, depending on conditions. 1

(5) In the above embodiment, an AC voltage component is superimposed on a bias voltage supplied by the developing bias power supply unit 15. Alternatively, it may be possible not to superimpose an AC voltage component on a bias voltage.

Also, it may be possible to superimpose an AC voltage component on a bias voltage to be applied to the secondary transfer roller 35 by the developing bias power supply unit 15.

(6) In the above embodiment, the cleaning operation is controlled by controlling the cleaning rotation number. Alternatively, it may be possible to control the cleaning operation by controlling a cleaning period necessary for performing the cleaning. In this way, it is possible to control the cleaning operation by controlling an amount corresponding to a cleaning period showing a period necessary for performing the cleaning operation such as the cleaning rotation number and the cleaning period.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus including: a bias voltage controller-that controls a bias voltage to be applied to a developing roller; an image former that performs image formation by forming a toner image on an image carrier using a toner supplied from the developing roller to which the controlled bias voltage is applied, primarily transfers the toner image onto a running intermediate transfer member, and secondarily transfers the toner image onto a recording sheet using a transfer voltage applied to a secondary transfer roller; and a cleaner that cleans the secondary transfer roller by applying the bias voltage to the secondary transfer roller as a cleaning voltage necessary for cleaning the secondary transfer roller, and reversely transferring the toner adhered to a circumferential surface of the secondary transfer roller onto the intermediate transfer member, the cleaner comprising:

a switcher operable to switch between electric paths such that the bias voltage is applied to the secondary transfer roller as the cleaning voltage, instead of the transfer voltage;

an instruction part operable to, if a present absolute value of the bias voltage is less than a threshold value, instruct the bias voltage controller to control the absolute value so as to be no less than the threshold value; and a secondary transfer roller driver operable to, if the bias voltage controller receives the instruction by the instruction part and controls the absolute value, move the secondary transfer roller such that the secondary transfer roller is kept separated from the intermediate transfer member for a predetermined period, and if the bias voltage controller does not receive the instruction by the instruction part, keep the secondary transfer roller in pressure-contact with the intermediate transfer member.

2. The image forming apparatus of claim 1, wherein if the instruction part instructs the bias voltage controller to control the absolute value of the bias voltage so as to be no less than the threshold value, the instruction part further instructs the bias voltage controller to, after the cleaner completes cleaning of the secondary transfer roller, restore the controlled bias voltage to the bias voltage that has been used till the reception of the instruction, and if the bias voltage controller restores the bias voltage, the secondary transfer roller driver keeps the secondary transfer roller separated from the intermediate transfer member for the predetermined period.

3. The image forming apparatus of claim 1, wherein the predetermined period corresponds to a period that starts when a toner adhered to the image carrier due to the control of the absolute value is transferred onto the intermediate transfer member and ends when a part of the intermediate transfer member onto which the toner has been transferred passes by a transfer position of the secondary transfer roller by running of the intermediate transfer member.

4. The image forming apparatus of claim 2, wherein the predetermined period corresponds to a period that starts when a toner adhered to the image carrier due to the control of the absolute value is transferred onto the intermediate transfer member and ends when a part of the intermediate transfer member onto which the toner has been transferred passes by a transfer position of the secondary transfer roller by running of the intermediate transfer member.

5. The image forming apparatus of claim 1, wherein:

the cleaner further comprises:

a detector operable to detect temperature and/or humidity within the image forming apparatus; and a changer operable to change an amount corresponding to a period necessary for cleaning the secondary transfer roller in accordance with the temperature and/or humidity detected by the detector.

6. The image forming apparatus of claim 1, wherein the cleaner further comprises:

a deterioration state acquisition part operable to acquire information relating to a deterioration state of the toner; and a changer operable to change an amount corresponding to a period necessary for cleaning the secondary transfer roller in accordance with the information relating to the deterioration state acquired by the deterioration state acquisition part.

7. The image forming apparatus of claim 1, wherein the cleaner cleans the circumferential surface of the secondary transfer roller to which the toner has been adhered by alternately switching a voltage to be applied to the secondary transfer roller between the bias voltage as the cleaning voltage and the transfer voltage.

8. The image forming apparatus of claim 1, further comprising:

a judgment part operable to judge whether the secondary transfer roller needs to be cleaned; and a controller operable to control operations of the image former, wherein if the judgment part judges affirmatively while the image former performs the image formation, and a toner image is primarily transferred onto the intermediate transfer member, the controller controls the image former so as to suspend the image forming operation after the toner image is secondarily transferred onto a recording sheet, and then restart the image forming operation after the cleaner completes cleaning of the secondarily transfer roller.

9. A cleaning method of cleaning a secondary transfer roller that is used in an image forming apparatus including: a bias voltage controller that controls a bias voltage to be applied to a, developing roller; an image former that performs image formation by forming a toner image on an image carrier using a toner supplied from the developing roller to which the controlled bias voltage is applied, primarily transfers the toner image onto a running intermediate transfer member, and secondarily transfers the toner image onto a recording sheet using a transfer voltage applied to the secondary transfer roller; and a cleaner that cleans the secondary transfer roller by applying the bias voltage to the secondary transfer roller as a cleaning voltage necessary for cleaning the secondary transfer roller, and reversely transferring the toner adhered to a circumferential surface of the secondary transfer roller onto the intermediate transfer member, the cleaning method comprising:

a switching step of switching between electric paths such that the bias voltage is applied to the secondary transfer roller as the cleaning voltage, instead of the transfer voltage;

an instructing step of, if a present absolute value of the bias voltage is less than a threshold value, instructing the bias voltage controller to control the absolute value so as to be no less than the threshold value; and a secondary transfer roller driving step of, if the bias voltage controller receives the instruction by the instructing step and controls the absolute value, moving the secondary transfer roller such that the secondary transfer roller is kept separated from the intermediate transfer member for a predetermined period, and if the bias voltage controller does not receive the instruction by the instructing step, keeping the secondary transfer roller in pressure-contact with the intermediate transfer member.

10. The cleaning method of claim 9, wherein if the instructing step instructs the bias voltage controller to control the absolute value of the bias voltage so as to be no less than the threshold value, the instructing step further instructs the bias voltage controller to, after the cleaner completes cleaning of the secondary transfer roller, restore the controlled bias voltage to the bias voltage that has been used till the reception of the instruction, and if the bias voltage controller restores the bias voltage, the secondary transfer roller driving step keeps the secondary transfer roller separated from the intermediate transfer member for the predetermined period.

11. The cleaning method of claim 9, wherein, the predetermined period corresponds to a period that starts when a toner adhered to the image carrier due to the control of the absolute value is transferred onto the intermediate transfer member and ends when a part of the intermediate transfer member onto which the toner has been transferred passes by a transfer position of the secondary transfer roller by running of the intermediate transfer member.

12. The cleaning method of claim 10, wherein, the predetermined period corresponds to a period that starts when a toner adhered to the image carrier due to the control of the absolute value is transferred onto the intermediate transfer member and ends when a part of the intermediate transfer member onto which the toner has been transferred passes by a transfer position of the secondary transfer roller by running of the intermediate transfer member.

13. The cleaning method of claim 9, further comprising a detection step of detecting temperature and/or humidity within the image forming apparatus; and a changing step of changing an amount corresponding to a period necessary for cleaning the secondary transfer roller in accordance with the temperature and/or humidity detected by the detection step.

14. The cleaning method of claim 9, further comprising a deterioration state acquiring step of acquiring information relating to a deterioration state of the toner; and a changing step of changing an amount corresponding to a period necessary for cleaning the secondary transfer roller in accordance with the information relating to the deterioration state acquired by the deterioration state acquiring step.

15. The cleaning method of claim 9, further comprising the cleaner cleans the circumferential surface of the secondary transfer roller to which the toner has been adhered by alternately switching a voltage to be applied to the secondary transfer roller between the bias voltage as the cleaning voltage and the transfer voltage.

16. The cleaning method of claim 9, further comprising a judging step of judging whether the secondary transfer roller needs to be cleaned; and a controlling step of controlling operations of the image former, wherein if the judging step judges affirmatively while the image former performs the image formation, and a toner image is primarily transferred onto the intermediate transfer member, the controlling step controls the image former so as to suspend the image forming operation after the toner image is secondarily transferred onto a recording sheet, and then restarting the image forming operation after the cleaner completes cleaning of the secondarily transfer roller.

* * * * *